US009475504B2

(12) United States Patent
Hirashima et al.

(10) Patent No.: US 9,475,504 B2
(45) Date of Patent: Oct. 25, 2016

(54) RAILCAR AND METHOD FOR MANUFACTURING THE SAME

(71) Applicant: KAWASAKI JUKOGYO KABUSHIKI KAISHA, Hyogo (JP)

(72) Inventors: Toshiyuki Hirashima, Kobe (JP); Shirou Honma, Kobe (JP); Kei Uchida, Akashi (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 127 days.

(21) Appl. No.: 14/502,607

(22) Filed: Sep. 30, 2014

(65) Prior Publication Data

US 2015/0096460 A1 Apr. 9, 2015

(30) Foreign Application Priority Data

Oct. 3, 2013 (JP) ..... 2013-207980

(51) Int. Cl.
*B61D 17/06* (2006.01)
*B61F 1/00* (2006.01)

(52) U.S. Cl.
CPC ..... *B61F 1/00* (2013.01); *B61D 17/06* (2013.01); *Y10T 29/49622* (2015.01)

(58) Field of Classification Search
CPC .... B61D 17/00; B61D 17/04; B61D 17/041; B61D 17/043; B61D 17/06; B61D 17/08; B61D 17/10; B61D 17/12
USPC ..... 105/396, 397, 402, 403, 404, 410, 411, 105/413–415, 421
See application file for complete search history.

(56) References Cited

U.S. PATENT DOCUMENTS 7,900,565 B2 * 3/2011 Bravo ..... B61C 17/04 105/340

FOREIGN PATENT DOCUMENTS

JP 2011-235728 A 11/2011
JP 2012-228958 A 11/2012

* cited by examiner

*Primary Examiner* — Robert McCarry, Jr.
(74) *Attorney, Agent, or Firm* — Studebaker & Brackett PC

(57) ABSTRACT

An end bodyshell of a railcar bodyshell includes: a pair of end posts provided at a width direction middle portion of the end bodyshell; corner posts respectively provided at both width direction end portions of the end bodyshell; an end plate to which upper portions of the end posts and upper portions of the corner posts are coupled; and an end-side end beam to which lower portions of the end posts and lower portions of the corner posts are coupled. The end-side end beam includes: a middle member connecting the end posts in the width direction; and two side members each connecting the end post and the corner post in the width direction.

9 Claims, 5 Drawing Sheets

RAILCAR AND METHOD FOR MANUFACTURING THE SAME

TECHNICAL FIELD

The present invention relates to a railcar and a method for manufacturing the railcar, particularly to the structures of an end bodyshell and an underframe that are components of a railcar and a method for manufacturing the end bodyshell and the underframe.

BACKGROUND ART

Japanese Laid-Open Patent Application Publication No, 2011-235728 discloses a railcar including a railcar bodyshell configured by joining an underframe, side bodyshells, end bodyshells, and a roof bodyshell. Each of the end bodyshells of the railcar is provided with: a pair of end posts provided at a car-width direction intermediate portion of the end bodyshell and extending in a vertical direction; and a pair of corner posts respectively provided at both car-width direction end portions of the end bodyshell and extending in the vertical direction. Upper portions of the end posts and upper portions of the corner posts are fixed to an upper portion reinforcing beam extending in a sleeper direction. Each of reinforcing members extending in the car-width direction couples an upper-lower direction middle portion of the end post and an upper-lower direction middle portion of the corner post. Post reinforcing members extending in the vertical direction stand on an end beam of the underframe so as to be located at positions corresponding to the end posts and corner posts of the end bodyshell. The underframe and the end bodyshell are coupled to each other by joining the post reinforcing members of the end beam of the underframe and the end posts and corner posts of the end bodyshell.

The end bodyshell of the railcar of Japanese Laid-Open Patent Application Publication No, 2012-228958 is provided with: the corner post including a lower end that reaches a lower surface of the underframe; and the end post (gangway post) including a lower end that reaches an upper-lower middle portion of the underframe.

SUMMARY OF INVENTION

Technical Problem

Generally, the end bodyshell and the underframe are separately assembled and then coupled to each other. For example, in PTL1, the end bodyshell to which the end posts, the corner posts, and the upper portion reinforcing beam are attached is joined to the reinforcing members standing on the underframe. For example, in PTL2, the end posts, the corner posts, a lintel, and bar members are attached to the end bodyshell, and lower end portions of the end posts and corner posts of the end bodyshell are inserted into through holes or cutouts formed on the underframe.

In the end bodyshell to which the end posts and the corner posts are attached, the end posts and the corner posts are coupled to one another in the car-width direction by beams or the like at upper portions and upper-lower intermediate portions of the end posts and corner posts. Therefore, the shape accuracy (accuracy of a post-to-post distance, an angle between the posts, an entire size, and the like) of the lower end portions of the end posts and corner posts is low. Therefore, coupled portions where the underframe and the end bodyshell are coupled to each other (in PTL1, the reinforcing members standing on the underframe; in PTL2, the through holes or cutouts formed on the underframe) are configured to be able to absorb an error of a positional relation of the lower end portions of the end posts and corner posts. For example, each of openings of the through holes or cutouts formed on the underframe is slightly larger than a cross-sectional size of each of the end posts and corner posts, and the underframe and each post are welded to each other via a gusset.

When the railcars collide with each other, the end bodyshell receives the impact, and the impact received by the end bodyshell is transferred through the end beams of the underframe to the underframe and the side bodyshells. The collision load received by the lower end portion of the end post is larger than that received by the upper end portion of the end post. Therefore, the coupled portion where the end bodyshell and the end beam are coupled to each other is an important portion from the viewpoint of collision safety and therefore requires high strength. On this account, at the coupled portions where the end posts and the corner posts are coupled to the end beams, the amount of welding tends to increase for securing the strength. However, the excessive amount of welding may become a factor for the breakage of the post from the base thereof at the time of the collision. To avoid the excessive welding, a worker is required to have a high degree of welding skill.

The end posts and the corner posts may be mechanically fastened to the end beam instead of the welding. However, as described above, since the shape accuracy of the coupled portion where the end bodyshell to which the end posts and the corner posts are attached in advance is coupled to the end beam is low, it is difficult to mechanically fasten the end bodyshell and the underframe by using fastening holes formed on the end bodyshell and the end beam in advance. Further, in consideration of the thickness of the end posts, the corner posts, and the underframe, it is difficult to form the fastening holes at an assembly site.

The present invention was made in consideration of the above circumstances, and an object of the present invention is to reduce the amount of welding at the coupled portion where the end bodyshell and end beam of the railcar bodyshell are coupled to each other. Another object of the present invention is to provide structures by which mechanical fastening is realized at the coupled portion where the end bodyshell and end beam of the railcar bodyshell are coupled to each other.

Solution to Problem

One aspect of the present invention is a railcar configured by coupling an underframe, side bodyshells, end bodyshells, and a roof bodyshell, wherein: each of the end bodyshells includes a pair of end posts provided at a car-width direction middle portion of the end bodyshell, a pair of corner posts respectively provided at both car-width direction end portions of the end bodyshell, an end horizontal member coupling upper portions of the end posts to upper portions of the corner posts, and an end-side end beam coupling lower portions of the end posts to lower portions of the corner posts; and the end-side end beam is constituted by a first member connecting the end posts in a car-width direction and second and third members each connecting the end post and the corner post in the car-width direction.

In the above railcar, it is preferable that the underframe include an underframe-side end beam coupled to the end-side end beam.

Another aspect of the present invention is a method for manufacturing a railcar configured by coupling an underframe, side bodyshells, end bodyshells, and a roof bodyshell, each of the end bodyshells including a pair of end posts, a pair of corner posts, an end horizontal member, and an end-side end beam, the method including: coupling lower portions of the pair of end posts to each other by a first member of the end-side end beam in a car-width direction; coupling upper portions of the pair of end posts to the end horizontal member; coupling lower portions of the end posts and lower portions of the corner posts to one another by second and third members of the end-side end beam in the car-width direction; and coupling the upper portions of the end posts and upper portions of the corner posts to the end horizontal member.

It is preferable that the method further include coupling the end-side end beam, attached to the end bodyshell in advance, and an underframe-side end beam provided at a car-longitudinal direction end portion of the underframe.

According to the railcar and the method for manufacturing the railcar, the end-side end beam is divided into the first member (middle member) located at the car-width direction middle and the second and third members (side members) respectively located at both car-width direction sides. The shape of the lower portion of the end bodyshell is defined by joining the middle member and the pair of end posts, joining the end posts and the side members, and joining the side members and the corner posts. A car-width direction length of each of the components of the end-side end beam is smaller than a car width, and the shape of each of the components of the end-side end beam is simple. Therefore, the shape accuracy of the end-side end beam is higher than that of the end-side end beam configured by combining a large number of members. Therefore, the end-side end beam, the end posts, and the corner posts can be directly joined to one another without gussets. On this account, the amount of welding at the coupled portion where the end beam and the end bodyshell are coupled to each other can be reduced.

According to the railcar and the method for manufacturing the railcar, the mechanical fastening between the end post and the end-side end beam and the mechanical fastening between the corner post and the end-side end beam can be realized. Fastening holes are formed on the end posts, the corner posts, and the middle member and side members of the end-side end beam in a manufacturing process, and the mechanical fastening between the end post and the middle member, the mechanical fastening between the end post and the side member, and the mechanical fastening between the corner post and the side member are performed by using the fastening holes at an assembling site. With this, the end posts and the corner posts can be attached to the end-side end beam while maintaining the excellent shape accuracy of the end bodyshell. Since the end posts and the corner posts are mechanically fastened to the end-side end beam as above, the amount of welding at the coupled portions where the end posts and the corner posts are coupled to the end beam can be reduced. With this, the deterioration of the shape accuracy of the end bodyshell and the underframe due to welding distortion can be suppressed.

According to the railcar and the method for manufacturing the railcar, the shape of the lower portion of the end bodyshell is defined by attaching a part (end-side end beam) of the end beam to the end bodyshell in advance. With this, the deterioration of the shape accuracy of the lower portion of the end bodyshell can be suppressed as compared to a case where only the upper portions of the end posts and the upper portions of the corner posts are coupled to the end horizontal member. As described above, the shape accuracy of the lower portion of the end bodyshell is relatively excellent. Therefore, when coupling the lower portion of the end bodyshell to the underframe, the lower portion of the end bodyshell and the underframe (underframe-side end beam) can be mechanically fastened to each other.

Advantageous Effects of Invention

According to the present invention, at the coupled portion where the end bodyshell and end beam of the railcar bodyshell are coupled to each other, the end posts, the corner posts, and the end beam can be directly joined to one another without gussets or the like. Therefore, at the coupled portion where the end bodyshell and the end beam are coupled to each other, the amount of welding can be reduced. At the coupled portion where the end bodyshell and the end beam are coupled to each other, the end bodyshell and the end beam can be mechanically fastened to each other. Since the amount of welding can be reduced by the mechanical fastening, the deterioration of the shape accuracy due to the welding, such as welding distortion, can be suppressed.

DESCRIPTION OF EMBODIMENTS

Figure 1:
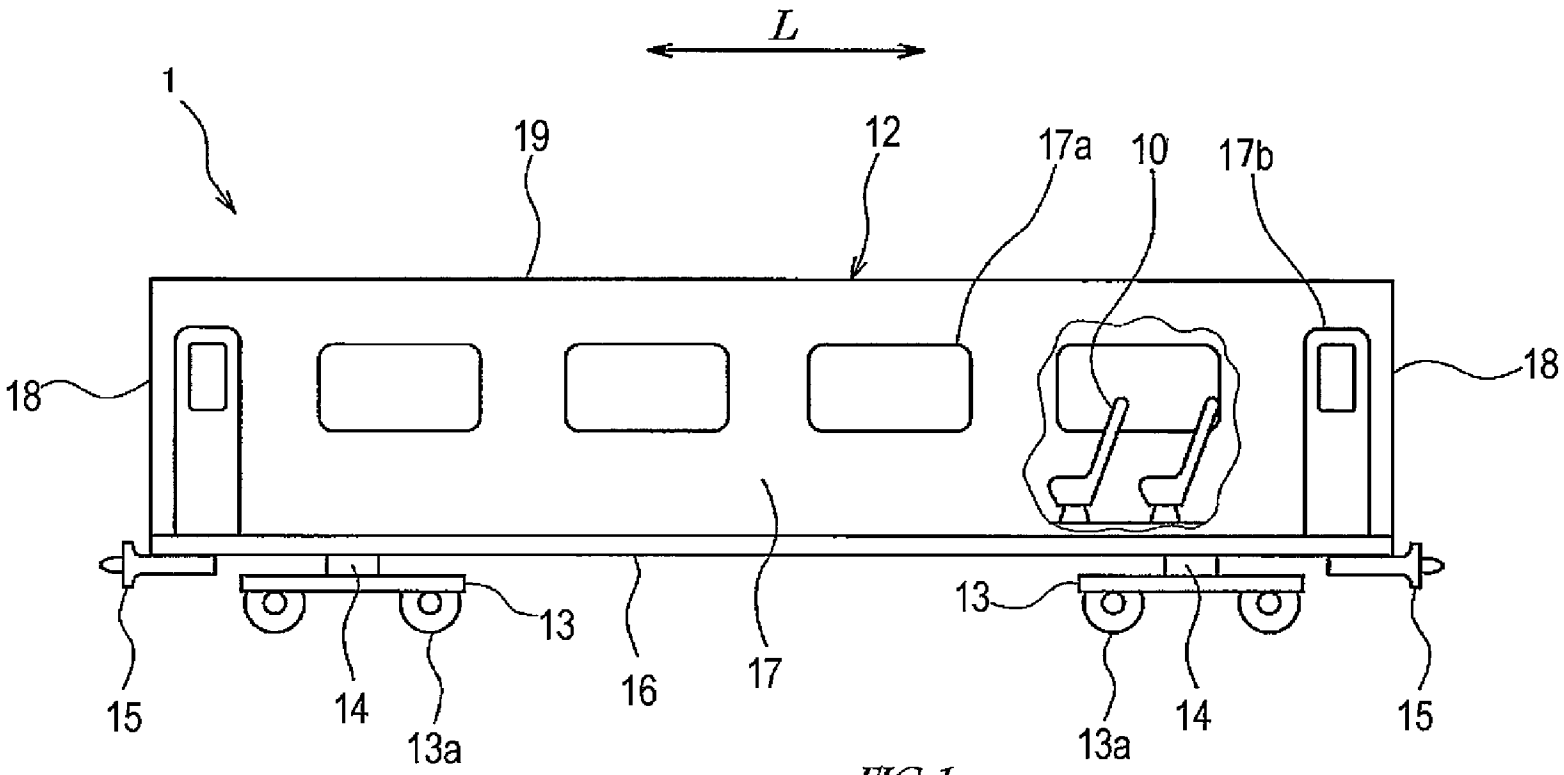
FIG. 1 is a side view showing a railcar according to one embodiment of the present invention.

FIG. 1 is a side view showing a railcar 1 according to one embodiment of the present invention. As shown in FIG. 1, the railcar 1 of Embodiment 1 includes: a carbody 12 including a passenger room on which passengers get; and bogies 13, at each of which wheels 13*a* are provided and which support the carbody 12 via secondary springs 14. The carbody 12 is constituted by: an underframe 16 that is a bottom portion of the carbody; side bodyshells 17 each including window opening portions 17*a*, door opening portions 17*b*, and a lower end portion connected to a car-width direction (hereinafter simply referred to as a "width direction") side portion of the underframe 16; end bodyshells 18 each including a lower end portion connected to a car-longitudinal direction L (hereinafter simply referred to as a "longitudinal direction L") end portion of the underframe 16; and a roof bodyshell 19 connected to upper end portions of the side bodyshells 17 and upper end portions of the end bodyshells 18. Each of the door opening portions 17*b* of the side bodyshells 17 is located at a longitudinal direction L outer side of the bogie 13. Passenger seats 10 are provided in an internal space of the carbody 12 so as to be located at a longitudinal direction L inner side of the door opening portion 17*b*. Couplers 15 configured to couple the adjacent cars to each other are respectively provided at longitudinal direction L end portions of the underframe 16. Each of the couplers 15 projects outwardly of the end bodyshell 18 in the longitudinal direction L. In the present specification, the inner side or inward (inwardly) denotes an inside when viewed from the inside of the carbody 12, and the outer side or outward (outwardly) denotes an outside when viewed from the inside of the carbody 12.

Figure 2:
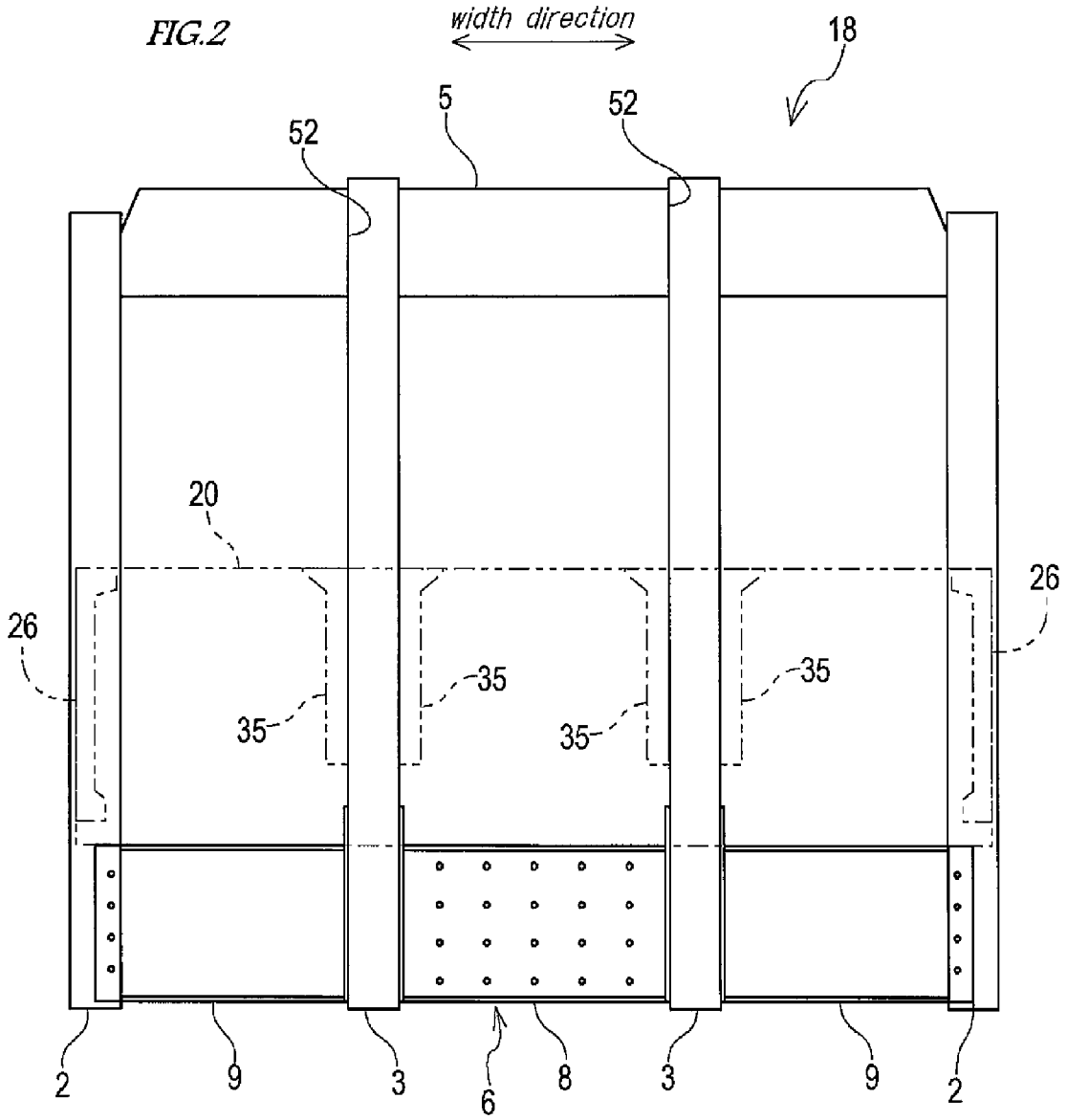
FIG. 2 is a front view of major components of an end bodyshell.

FIG. 2 is a front view of major components of the end bodyshell 18. As shown in FIG. 2, the end bodyshell 18 includes, as the major components, a pair of corner posts 2 respectively located at both width direction end portions of the end bodyshell 18 and extending in a vertical direction, a pair of end posts 3 located at a width direction inner side of the corner posts 2 and extending in the vertical direction, an end horizontal member 5 extending in the width direction, and an end-side end beam 6 extending in the width direction. Upper portions of the corner posts 2 and upper portions of the end posts 3 are coupled to one another by the end horizontal member 5 in the width direction. Lower portions of the corner posts 2 and lower portions of the end posts 3 are coupled to one another by the end-side end beam 6 in the width direction. The end-side end beam 6 is constituted by three divided members that are a middle member 8 coupling the pair of end posts 3 in the width direction and two side members 9 each coupling the end post 3 and the corner post 2 in the width direction.

Figure 3:
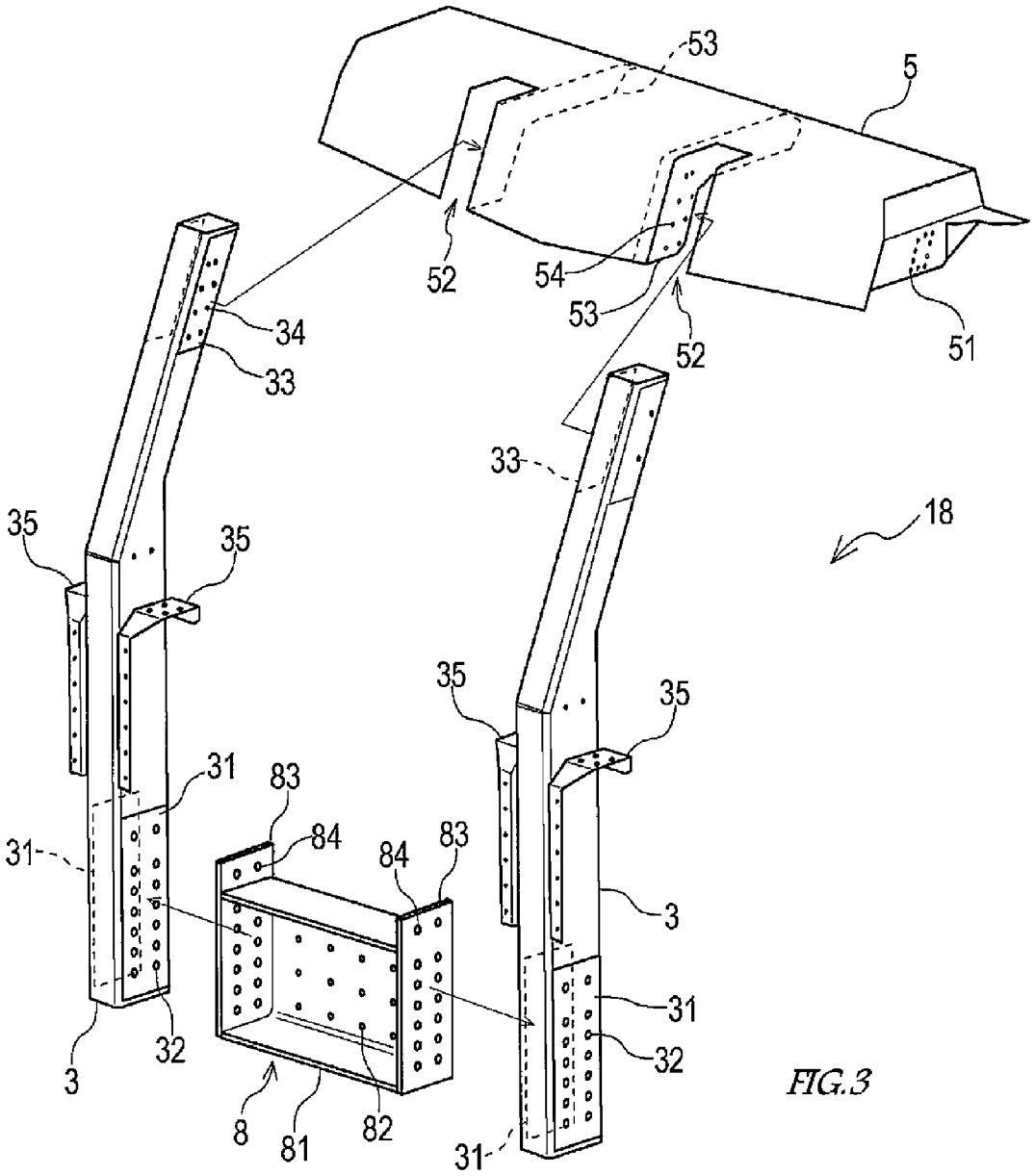
FIG. 3 is a diagram for explaining the first half of an assembling process of the end bodyshell.
Figure 4:
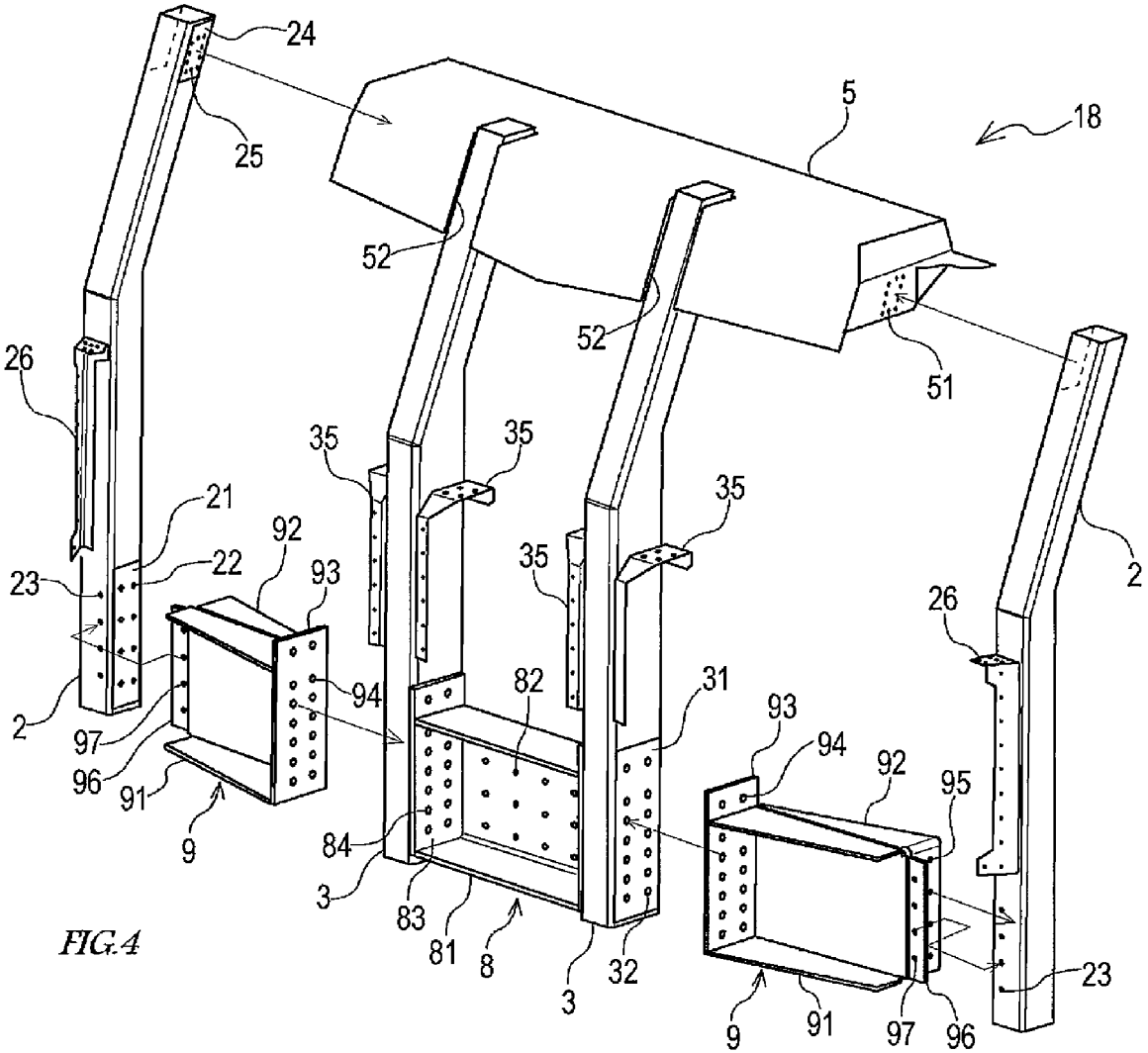
FIG. 4 is a diagram for explaining the second half of the assembling process of the end bodyshell.

The assembling process of the end bodyshell 18 and the structure of the end bodyshell 18 will be explained in detail. FIG. 3 is a diagram for explaining the first half of the assembling process of the end bodyshell. FIG. 4 is a diagram for explaining the second half of the assembling process of the end bodyshell. As shown in FIG. 3, first, the lower portions of the pair of end posts 3 are coupled to each other in the width direction by the middle member 8, and then, the upper portions of the pair of end posts 3 are coupled to the end horizontal member 5.

Lower portion joining plates 31 are respectively fixed to lower portions of two width direction surfaces of each end post 3. Each of the lower portion joining plates 31 is provided with a plurality of fastening holes 32 penetrating the lower portion joining plate 31 and a wall of the end post 3. The fastening holes 32 are formed by drilling in a manufacturing process of the end post 3 at a factory or the like. Upper portion joining plates 33 are respectively fixed to upper portions of opposing surfaces of the end posts 3. Each of the upper portion joining plates 33 is provided with a plurality of fastening holes 34 penetrating the upper portion joining plate 33 and the wall of the end post 3. The fastening holes 34 may be formed by drilling in the manufacturing process of the end post 3 at a factory or the like or may be formed by drilling in an assembling process of the end bodyshell 18 at an assembling site. Brackets 35 for attaching an end panel cover 20 are respectively fixed to upper-lower middle portions of two width direction surfaces of each end post 3. In the present embodiment, the lower portion joining plates 31 and the upper portion joining plates 33 are thick plates and are welded to the end post 3 by fillet welding. The lower portion joining plates 31 and upper portion joining plates 33 welded to the end posts 3 are subjected to machine work, so that the fastening holes 32 are formed on the lower portion joining plates 31, the fastening holes 34 are formed on the upper portion joining plates 33, and the lower portion joining plates 31 and the upper portion joining plates 33 are adjusted in thickness. Thus, the accuracy of the surfaces, to which the middle member 8, the side members 9, and the end horizontal member 5 are attached, of the end posts 3 is secured.

The middle member 8 of the end-side end beam 6 has a width direction length substantially equal to a distance between the pair of end posts 3. The middle member 8 is constituted by: a main body 81 whose cross section in the longitudinal direction L has a U shape that is open outwardly in the longitudinal direction L; and joining plates 83 (joint portions) respectively welded to both width direction ends of the main body 81. The main body 81 is configured such that a joint surface facing in the car-longitudinal direction L and upper and lower surfaces respectively located at upper and lower sides of the joint surface are formed integrally. The joint surface of the main body 81 is provided with a plurality of fastening holes 82 used for mechanical fastening to a below-described underframe-side end beam 7. Each of the joining plates 83 is provided with a plurality of fastening holes 84 located at positions corresponding to the plurality of fastening holes 32 provided at the lower portion joining plate 31 of the end post 3. The main body 81 is only required to have the U shape in the cross section thereof in the longitudinal direction L. For example, the main body 81 may be a member whose cross section in the longitudinal direction L has a U shape, a short U shape, a groove shape, a short groove shape, or a C shape, which is open outwardly in the longitudinal direction L. Since the main body 81 has such a shape, the joint surface joined to the below-described underframe-side end beam 7 is located at the inner side in the longitudinal direction L, and fastening members, such as bolts, inserted through the joint surface can be handled at the outer side in the longitudinal direction L. The middle member 8 may be a member obtained by integrally forming the main body 81 and the joining plates 83.

The end horizontal member 5 has a width direction length substantially equal to the distance between the pair of corner posts 2. Each of both width direction ends of the end horizontal member 5 is provided with a plurality of fastening holes 51 used for the mechanical fastening to the corner post 2. A width direction middle portion of the end horizontal member 5 is provided with two cutouts 52 through which the upper portions of the end posts 3 are respectively inserted. Joining plates 53 are respectively provided inside the cutouts 52 so as to be respectively opposed to the upper portion joining plates 33 of the end posts 3. Each of the joining plates 53 is provided with a plurality of fastening holes 54 located at positions corresponding to the plurality of fastening holes 34 provided at the upper portion joining plate 33 of the end post 3.

According to the end posts 3 and the middle member 8 configured as above, the lower portion joining plate 31 of the end post 3 and the joining plate 83 of the middle member 8 are mechanically fastened to each other. Specifically, the bolts are inserted through the fastening holes 32 of the lower portion joining plate 31 of the end post 3 and the fastening holes 84 of the joining plate 83 of the middle member 8. Thus, the wall, at which the lower portion joining plate 31 is provided, of the end post 3 and the joining plate 83 of the middle member 8 are fastened to each other by the bolts. Used as the bolts are one-side type high-strength lock bolts (such as huck bolts (trademark)).

According to the end posts 3 and the end horizontal member 5 configured as above, the upper portion joining plate 33 of the end post 3 and the joining plate 53 of the end horizontal member 5 are mechanically fastened to each other. Specifically, the bolts are inserted through the fastening holes 34 of the upper portion joining plate 33 of the end post 3 and the fastening holes 54 of the joining plate 53 of the end horizontal member 5. Thus, the wall, at which the upper portion joining plate 33 is provided, of the end post 3 and the joining plate 53 of the end horizontal member 5 are fastened to each other by the bolts. Used as the bolts are the lock bolts.

Next, as shown in FIG. 4, the end post 3 and the side member 9 are coupled to each other, the side member 9 and the corner post 2 are coupled to each other, and the corner post 2 and the end horizontal member 5 are coupled to each other.

Lower portion joining plates 21 are respectively fixed to lower portions of surfaces, respectively opposed to the end posts 3, of the corner posts 2. Each of the lower portion joining plates 21 is provided with a plurality of fastening holes 22 penetrating the lower portion joining plate 21 and a wall of the corner post 2. The plurality of fastening holes 22 are formed by drilling in a manufacturing process of the corner post 2. A plurality of fastening holes 23 are formed on each of longitudinal direction L outer side surfaces of the corner posts 2. Upper portion joining plates 24 are respectively fixed to upper portions of surfaces, respectively opposed to the end posts 3, of the corner posts 2. Each of the upper portion joining plates 24 is provided with a plurality of fastening holes 25 penetrating the upper portion joining plate 24 and the wall of the corner post 2. Brackets 26 for attaching the end panel cover 20 are respectively fixed to the longitudinal direction L outer side surfaces of the corner posts 2. In the present embodiment, the lower portion joining plates 21 and the upper portion joining plates 24 are thick plates and are welded to the corner post 2 by fillet welding. The lower portion joining plates 21 and the upper portion joining plates 24 welded to the corner posts 2 are subjected to machine work, so that the fastening holes 22 are formed on the lower portion joining plates 21, the fastening holes 25 are formed on the upper portion joining plates 24, and the lower portion joining plates 21 and the upper portion joining plates 24 are adjusted in thickness. Thus, the accuracy of the surfaces, to which the side members 9 and the end horizontal member 5 are attached, of the corner posts 2 is secured.

Each of the side members 9 has a width direction length substantially equal to the distance between the corner post 2 and the end post 3. Each of the side members 9 is constituted by: a main body 91 having a U shape that is open outwardly in the longitudinal direction L; a joining frame 92 having a U shape that is open inwardly in the width direction; and a joining plate 93. The joining frame 92 is welded to a longitudinal direction L inner portion of the main body 91. The joining plate 93 is welded to a width direction inner portion of the main body 91. The joining plate 93 is provided with a plurality of fastening holes 94 located at positions corresponding to the plurality of fastening holes 32 of the lower portion joining plate 31 of the end post 3. A surface, opposed to the lower portion joining plate 21 of the corner post 2, of the joining frame 92 is provided with a plurality of fastening holes 95 corresponding to the plurality of fastening holes 22 of the lower portion joining plate 21. Further, the joining frame 92 is integrally provided with a flange 96 projecting outwardly in the width direction. The flange 96 is provided with a plurality of fastening holes 97 located at positions corresponding to the fastening holes 23 of the end post 3.

According to the end posts 3 and the side members 9 configured as above, the lower portion joining plate 31 of the end post 3 and the joining plate 93 of the side member 9 are mechanically fastened to each other. Specifically, the bolts are inserted through the fastening holes 32 of the lower portion joining plate 31 of the end post 3 and the fastening holes 94 of the joining plate 93 of the side member 9. Thus, the wall, at which the lower portion joining plate 31 is provided, of the end post 3 and the joining plate 93 of the side member 9 are fastened to each other by the bolts. Used as the bolts are the one-side type high-strength lock bolts.

According to the side members 9 and the corner posts 2 configured as above, the lower portion joining plate 21 of the corner post 2 and the joining frame 92 of the side member 9 are mechanically fastened to each other. Specifically, the bolts are inserted through the fastening holes 22 of the lower portion joining plate 21 of the corner post 2 and the fastening holes 95 of the joining frame 92 of the side member 9. Thus, the wall, at which the lower portion joining plate 21 is provided, of the corner post 2 and the joining frame 92 of the side member 9 are fastened to each other by the bolts. Used as the bolts are the one-side type high-strength lock bolts. Then, the bolts are inserted through the fastening holes 97 of the flange 96 of the joining frame 92 and the fastening holes 22 of the corner post 2. Thus, the wall of the corner post 2 and the flange 96 of the side member 9 are fastened to each other by the bolts. Used as the bolts are hexagon headed bolts.

Further, according to the corner posts 2 and the end horizontal member 5 configured as above, the upper portion joining plate 24 of the corner post 2 and the end horizontal member 5 are mechanically fastened to each other. Specifically, the bolts are inserted through the fastening holes 25 of the upper portion joining plate 24 of the corner post 2 and the fastening holes 51 provided at the width direction end portion of the end horizontal member 5. Thus, the upper portion joining plate 24 of the corner post 2 and the end horizontal member 5 are fastened to each other by the bolts. Used as the bolts are the lock bolts.

By the above steps, the corner posts 2, the end posts 3, the end horizontal member 5, and the end-side end beam 6 that are major components of the end bodyshell 18 are assembled. The end bodyshell 18 of the present embodiment is a cab end bodyshell, and the end panel cover 20, side panels, and the like are further attached to the major components of the end bodyshell 18. In a case where the end bodyshell 18 is a non-cab-end bodyshell, an end panel, side panels, a gangway facility, and the like are attached to the major components of the end bodyshell 18.

In the assembling process of the end bodyshell 18 described above, first, the lower portions of the pair of end posts 3 are coupled to each other, and then, the upper portions of the pair of end posts 3 are coupled to each other. Thus, a relative positional relation between the pair of end posts 3 is determined. Next, the lower portion of the corner post 2 and the lower portion of the end post 3 are coupled to each other, and the upper portion of the corner post 2 and the upper portion of the end post 3 are coupled to each other. Thus, a relative positional relation between the corner post 2 and the end post 3 is determined. According to conventional railcar bodyshells, the end beam is a component of the underframe 16. However, according to the railcar bodyshell of the present embodiment, the end beam is constituted by the end-side end beam 6 and the underframe-side end beam 7, and the end-side end beam 6 is attached to the end bodyshell 18. As above, since the end-side end beam 6 is attached to the end bodyshell 18 in advance, the shape accuracy of the lower portion of the end bodyshell 18 is increased.

In the above-described assembling process, the end-side end beam 6 is constituted by three divided members, so that the end bodyshell 18 in which the end posts 3 and the end-side end beam 6 are mechanically fastened to each other, and the end-side end beam 6 and the corner posts 2 are mechanically fastened to each other can be realized. Since the conventional end body shell is configured by combining a large number of members, manufacturing errors due to welding distortion or the like occur. However, since the end-side end beam 6 of the present embodiment is constituted by three divided members, the width direction size of each member is small, and the shape of each member is simple, so that the shape accuracy of each member improves. Further, since the fastening holes of the corner posts 2, the end posts 3, and the end-side end beam 6 are formed by drilling in the manufacturing process, the accuracy of the fastening holes is relatively high. Since the corner posts 2 and the end-side end beam 6 are mechanically fastened to each other by using the fastening holes, and the end posts 3 and the end-side end beam 6 are mechanically fastened to each other by using the fastening holes, the positional accuracy of the posts is increased. Therefore, even in a case where there are some manufacturing errors of the corner posts 2, the end posts 3, and the end-side end beam 6, the corner posts 2 and the end-side end beam 6 can be mechanically fastened to each other, and the end posts 3 and the end-side end beam 6 can be mechanically fastened to each other. Further, the shape accuracy of the lower portion of the end bodyshell 18 becomes higher than that in a case where the conventional end body shell is configured by combining a large number of members.

In the above-described assembling process, when coupling the corner posts 2 and the end-side end beam 6 and coupling the end posts 3 and the end-side end beam 6, the welding and drilling are not performed at the assembling site. Therefore, the amount of welding of the end bodyshell 18 can be reduced, and the deterioration of the shape accuracy of the end bodyshell 18 due to the welding distortion or the like can be suppressed.

Figure 5:
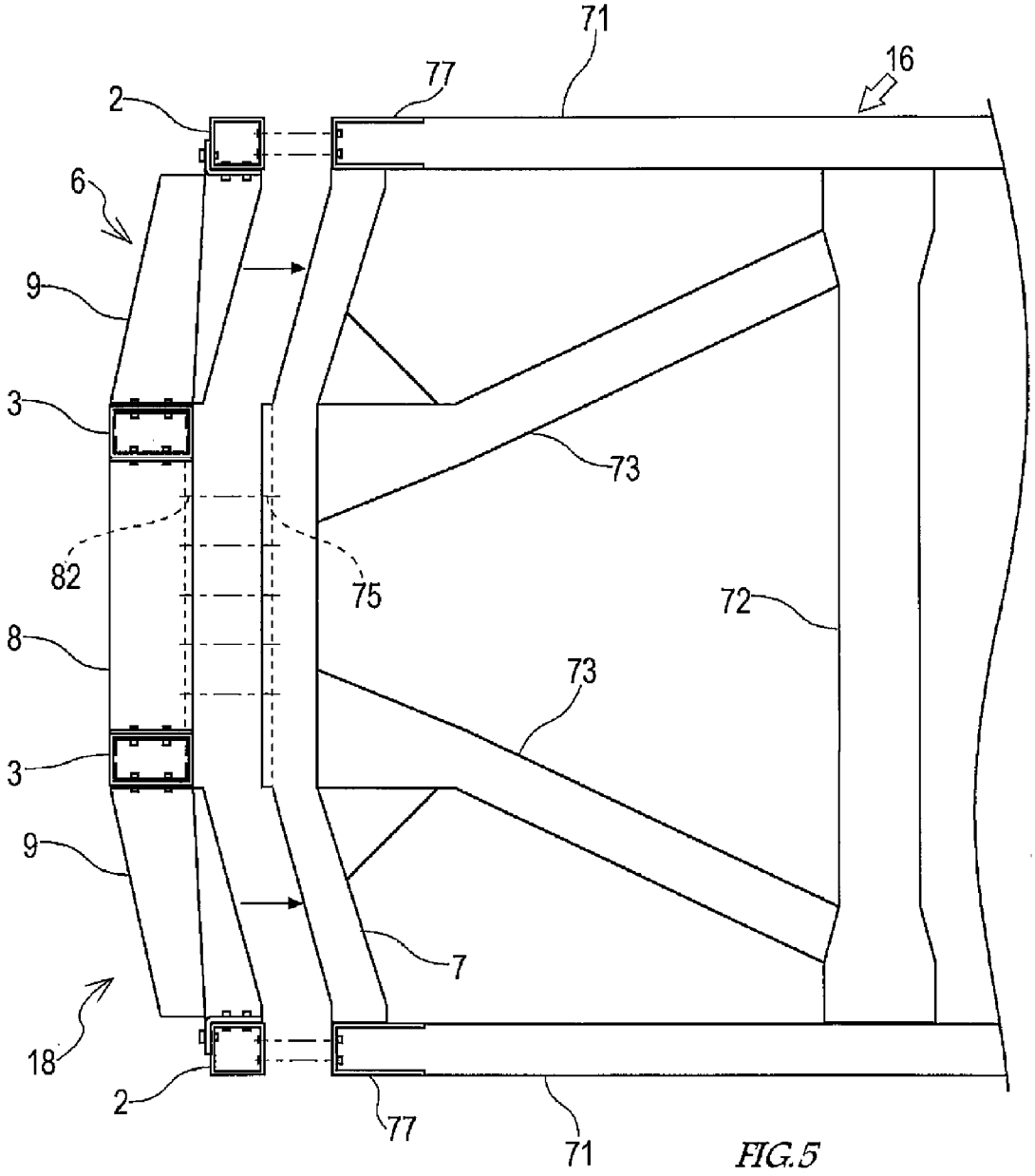
FIG. 5 is a plan view showing a coupled portion where the end bodyshell and an underframe are coupled to each other.

The end bodyshell 18 to which at least the corner posts 2, the end posts 3, the end horizontal member 5, and the end-side end beam 6 are attached as described above is coupled to the underframe 16. Next, the structure of the underframe 16 and the coupling structure between the underframe 16 and the end bodyshell 18 will be explained. FIG. 5 is a plan view showing the coupled portion where the end bodyshell 18 and the underframe 16 are coupled to each other. In FIG. 5, only the corner posts 2, the end posts 3, and the end-side end beam 6 are shown among the components of the end bodyshell 18.

As shown in FIG. 5, the underframe 16 includes: a pair of side sills 71 respectively provided at both width direction ends of the underframe 16; a bolster beam 72 provided at a longitudinal direction L middle portion of the underframe 16 and extending in the width direction so as to connect the side sills 71; underframe-side end beams 7 respectively provided at both longitudinal direction L end portions of the underframe 16 and extending in the width direction so as to connect the side sills 71; and center sills 73 each connecting the underframe-side end beam 7 and the bolster beam 72. Stays 77 are respectively fixed to the longitudinal direction end portions of the side sills 71. Each of the stays 77 is provided with a plurality of fastening holes (not shown) located at positions corresponding to a plurality of fastening holes (not shown) formed on a longitudinal direction L inner surface of the corner post 2 of the end bodyshell 18.

In a plan view, the shape of a longitudinal direction L outer portion of the underframe-side end beam 7 complementarily corresponds to the shape of a longitudinal direction L inner portion of the end-side end beam 6 of the end bodyshell 18. A portion, at least joined to the middle member 8 of the end-side end beam 6, of the underframe-side end beam 7 has a U shape that is open inwardly in the longitudinal direction L. A surface, facing in the longitudinal direction L, of the underframe-side end beam 7 is provided with a plurality of fastening holes 75 located at positions corresponding to the fastening holes 82 of the middle member 8 of the end-side end beam 6.

When coupling the end bodyshell 18 and the underframe 16, the end bodyshell 18 and the underframe 16 are positioned such that the longitudinal direction L inner portion of the end-side end beam 6 contacts the longitudinal direction L outer portion of the underframe-side end beam 7. Then, the stays 77 provided at the side sills 71 of the underframe 16 and the corner posts 2 of the end bodyshell 18 are mechanically fastened to each other. Further, the end-side end beam 6 and the underframe-side end beam 7 are mechanically fastened to each other. Specifically, the bolts are inserted through the fastening holes 82 of the middle member 8 of the end-side end beam 6 and the fastening holes 75 of the underframe-side end beam 7. Thus, the middle member 8 of the end-side end beam 6 and the underframe-side end beam 7 are fastened to each other by the bolts. In addition, the side members 9 of the end-side end beam 6 and the underframe-side end beam 7 may be joined to each other by welding.

In the present embodiment, not only the assembly of the end bodyshell 18 but also the coupling between the end bodyshell 18 and the underframe 16 is mainly realized by mechanical fastening. As described above, since the end-side end beam 6 is attached to the end bodyshell 18 in advance, the shape accuracy of the lower portion of the end bodyshell 18 is increased to such a degree that the mechanical fastening to the underframe-side end beam 7 is realized. With this, the end bodyshell 18 and the underframe 16 can be mechanically fastened to each other.

The foregoing has explained a preferred embodiment of the present invention. However, the above configurations can be modified as below, for example.

In the above embodiment, the corner post 2 and end-side end beam 6 of the end bodyshell 18 are mechanically fastened to each other, and the end post 3 and end-side end beam 6 of the end bodyshell 18 are mechanically fastened to each other. However, for example, these may be welded to each other. Even in this case, the end-side end beam 6 is constituted by three divided members, and the welding between the end post 3 and the middle member 8, the welding between the end post 3 and the side member 9, and the welding between the side member 9 and the corner post 2 are performed in this order. At welded portions between the end post 3 and the middle member 8, between the end post 3 and the side member 9, and between the side member 9 and the corner post 2, gussets are unnecessary. Thus, the amount of welding can be made smaller than those of conventional cases.

In the above embodiment, the end bodyshell 18 is the cab end bodyshell. However, for example, the characteristic structure of the end bodyshell 18 may be applied to the non-cab-end bodyshell. The pair of end posts 3 of the end bodyshell 18 may be replaced with a pair of collision posts or a pair of gangway posts.

REFERENCE SIGNS LIST

1 railcar
2 corner post
3 end post
5 end horizontal member
6 end-side end beam
7 underframe-side end beam
8 middle member (first member)
81 main body
83 joining plate
9 side member (second and third members)

91 main body
92 joining frame
93 joining plate
12 carbody
13 bogie
16 underframe
17 side bodyshell
18 end bodyshell
19 roof bodyshell

The invention claimed is:

1. A railcar configured by coupling an underframe, side bodyshells, end bodyshells, and a roof bodyshell, wherein:

each of the end bodyshells includes a pair of end posts provided at a car-width direction middle portion of the end bodyshell, a pair of corner posts respectively provided at both car-width direction end portions of the end bodyshell, an end horizontal member coupling upper portions of the end posts to upper portions of the corner posts, and an end-side end beam coupling lower portions of the end posts to lower portions of the corner posts; and the end-side end beam includes a first member connecting, and being positioned substantially between, the end posts in a car-width direction, and second and third members each connecting, and being positioned substantially between, the end post and the corner post in the car-width direction.

2. The railcar according to claim 1, wherein the underframe includes an underframe-side end beam coupled to the end-side end beam.

3. The railcar according to claim 2, wherein:

at least one of the first member, the second member, and the third member of the end-side end beam includes a main body having a U shape and extending in the car-width direction, the U shape being constituted by a joint surface facing in a car-longitudinal direction and upper and lower surfaces respectively located at upper and lower sides of the joint surface and being open outwardly in the car-longitudinal direction; and the joint surface of the end-side end beam is joined to a surface, facing in the car-longitudinal direction, of the underframe-side end beam.

4. The railcar according to claim 2, wherein at least one of the first member, the second member, and the third member of the end-side end beam includes:

a main body extending in the car-width direction; and joint portions respectively provided at both car-width direction end portions of the main body and each joined to the end post or the corner post.

5. The railcar according to claim 4, wherein:

the end post and the joint portion joined to the end post include corresponding fastening holes, and the end post and the joint portion are mechanically fastened to each other by using the fastening holes; or the corner post and the joint portion joined to the corner post include corresponding fastening holes, and the corner post and the joint portion are mechanically fastened to each other by using the fastening holes.

6. The railcar according to claim 4, wherein:

the underframe-side end beam and the main body include corresponding fastening holes; and the underframe-side end beam and the main body are mechanically fastened to each other.

7. A method for manufacturing a railcar configured by coupling an underframe, side bodyshells, end bodyshells, and a roof bodyshell, each of the end bodyshells including a pair of end posts, a pair of corner posts, an end horizontal member, and an end-side end beam, the method comprising:

coupling lower portions of the pair of end posts to each other by a first member of the end-side end beam in a car-width direction;

coupling upper portions of the pair of end posts to the end horizontal member;

coupling lower portions of the end posts and lower portions of the corner posts to one another by second and third members of the end-side end beam in the car-width direction; and coupling the upper portions of the end posts and upper portions of the corner posts to the end horizontal member.

8. The method according to claim 7, further comprising coupling the end-side end beam, attached to the end bodyshell in advance, and an underframe-side end beam provided at a car-longitudinal direction end portion of the underframe.

9. The railcar according to claim 3, wherein at least one of the first member, the second member, and the third member of the end-side end beam includes:

a main body extending in the car-width direction; and joint portions respectively provided at both car-width direction end portions of the main body and each joined to the end post or the corner post.

* * * * *